US007043858B2

(12) United States Patent
Martinez

(10) Patent No.: US 7,043,858 B2
(45) Date of Patent: May 16, 2006

(54) BACKHOE PIVOT JOINT

(75) Inventor: David V. Martinez, Fort Madison, IA (US)

(73) Assignee: CNH America LLC, New Holland, PA (US)

( * ) Notice: Subject to any disclaimer, the term of this patent is extended or adjusted under 35 U.S.C. 154(b) by 51 days.

(21) Appl. No.: 10/832,942

(22) Filed: Apr. 27, 2004

(65) Prior Publication Data

US 2005/0241196 A1 Nov. 3, 2005

(51) Int. Cl.
*E02F 3/32* (2006.01)

(52) U.S. Cl. ..... 37/443; 37/466; 403/154

(58) Field of Classification Search ..... 37/466, 37/443, 409, 410, 455; 403/154
See application file for complete search history.

(56) References Cited

U.S. PATENT DOCUMENTS

| | | | | |
|---|---|---|---|---|
| 2,847,238 | A | 8/1958 | Bolling, Jr. | |
| 2,967,726 | A * | 1/1961 | Weston | 403/157 |
| 3,964,799 | A * | 6/1976 | Knapp | 384/129 |
| 3,979,994 | A * | 9/1976 | Collignon | 411/351 |
| 4,096,957 | A * | 6/1978 | Iverson et al. | 414/715 |
| T0,985,006 | I4 * | 8/1979 | Drochner | 403/163 |
| 4,188,146 | A | 2/1980 | Stecklein | |
| 4,243,341 | A | 1/1981 | Kabay et al. | |
| 4,352,586 | A | 10/1982 | Hayden | |
| 4,400,898 | A | 8/1983 | Christensen et al. | |
| 4,607,977 | A | 8/1986 | Varnelis et al. | |
| 4,609,322 | A * | 9/1986 | Quant | 414/685 |
| 4,621,973 | A | 11/1986 | Langenfeld et al. | |
| 4,629,353 | A | 12/1986 | Burke | |
| 5,088,881 | A | 2/1992 | Ball et al. | |
| 5,593,264 | A * | 1/1997 | Schlegel et al. | 411/522 |
| 6,135,664 | A * | 10/2000 | Eckendorff | 403/13 |
| 6,694,571 | B1 * | 2/2004 | Albright et al. | 16/386 |

* cited by examiner

*Primary Examiner*—Victor Batson
(74) *Attorney, Agent, or Firm*—Stephen A. Bucchianeri; John William Stader; Michael G. Harms

(57) ABSTRACT

A backhoe coupling for joining members of a backhoe attachment is provided, the coupling having a pivot pin assembly that includes a pivot pin and a retaining plate. The pin has a groove for receiving the retaining plate. The retaining plate has an edge that is sized to fit into the groove and prevent it from being extracted. The groove has two blocked regions on opposing sides of the pin that prevent the pin from rotating freely with respect to the retaining plate.

10 Claims, 4 Drawing Sheets

BACKHOE PIVOT JOINT

FIELD OF THE INVENTION

This invention relates to generally to work vehicles. More particularly, it relates to couplings for work vehicles. Even more particularly it relates to pivot joints for excavators and loaders.

BACKGROUND OF THE INVENTION

Work vehicles such as wheel loaders, backhoes, loader-backhoes, excavators, skid steers, graders, trenchers, tractors, combines, balers, cotton pickers, telehandlers, forklifts, and other material handling or ground engaging vehicles often include members that are coupled together to pivot with respect to one another at pivot joints. These members are most commonly moved by actuators, for example, hydraulic actuators such as hydraulic cylinders.

In a common arrangement, such as the backhoe attachment of a loader-backhoe, or the excavating attachment to an excavator, two elongate rigid members such as boom swing towers, booms, dippers or buckets are coupled together with a pivot pin at a pivot joint. A hydraulic cylinder extends between and is coupled to the two members. The cylinder pivots the two members with respect to one another about the pivot pin by extending and retracting.

Typically, the pin in a pivot joint has a structure for retaining the pin in place. In one arrangement snap rings are fastened to both ends of the pivot pin. The snap ring on one end prevents the pin from moving in one direction and the snap ring on the other end prevents the pin from moving in the other direction. In another arrangement, a shoulder or head is provided on one end of the pin, replacing one snap ring. The dual snap ring and ring-and-shoulder arrangements are acceptable for pivot joints that are not blind—i.e. when an operator can get access to both ends of the pivot pin.

Blind pivot joints, however, require different structures since one has no access to both ends of the pivot pin in its blind hole. In these situations, pivot pins have been provided with a retainer that is welded to and extends away from the pin. This retainer is fixed to the member in which the pin is inserted, typically with a bolt. This fixes the pin in the member by a connection at just one end, preventing pin movement either into or out of the joint. It also holds the pin stationary with respect to the member to which the retainer is fastened, and thus forces the pin to pivot with respect to one of the two members. Disadvantageously, this welded arrangement holds the pin rigidly with respect to the member, and does not let it float within the pivot pin hole.

An alternative arrangement for blind pivot joints includes a pin with a circumferential groove at one end and a retainer that fits into this groove. An advantage to this arrangement is the pin's ability to (1) wobble, float or self-align slightly within the pivot pin hole and (2) to rotate freely about its longitudinal axis.

Recently, however, this free rotation has been identified as a problem in some situations where the pin binds or corrodes in the pivot pin hole that supports it. In these situations it is beneficial to prevent the pin from rotating.

The free rotation could be prevented by welding the pin and retainer together in the prior art manner. This arrangement would, however, prevent the pin from self-aligning with respect to the hole.

What is needed, therefore, is an improved pivot pin assembly for blind holes that permits the pin to float, wobble or self-align slightly in the hole (like the arrangement with the circumferential groove), yet also retains the pin in a blind hole (like the welded arrangement).

It is an object of this invention to provide such a pivot pin assembly.

SUMMARY OF THE INVENTION

In accordance with a first embodiment of the invention, a backhoe pivot joint is provided, including a first backhoe member having first cylindrical opening; a second backhoe member having a second cylindrical opening, wherein said first and second longitudinal openings are disposed in a coaxial relation; a circular metal cylinder disposed in said first and second openings, said cylinder having a first end and a second end, said first end having a circumferential groove having at least one blocked groove portion; and a retaining plate removably fixed to said first member and having a first edge disposed in said circumferential groove.

The circumferential groove may have first and second blocked portions. The first and second blocked portions may be disposed about 180 degrees apart. The first and second blocked portions may subdivide the circumferential groove into a first arcuate portion and a second arcuate portion, each of the first and second arcuate portions having substantially equal length. The first end may have first and second recesses adjacent to the first and second blocked portions. The groove may have a finish that indicates the groove was formed by turning the cylinder on a machine tool. The first and second blocked portions may have a finish that indicates the first and second blocked portions were formed by pressing or stamping the groove.

In accordance with a second embodiment of the invention, a pivot pin assembly for a pivot joint of a work vehicle is provided, including a circular metal cylinder, the cylinder having a first end and a second end, the first end having a circumferential groove with at least one blocked groove portion; and a retaining plate removably fixed to the first member and having a first edge disposed in the circumferential groove.

The circumferential groove may have first and second blocked portions. The first and second blocked portions may be disposed about 180 degrees apart. The first and second blocked portions may subdivide the circumferential groove into a first arcuate portion and a second arcuate portion, each of the first and second arcuate portions having substantially equal length. The first end may have first and second recesses adjacent to the first and second blocked portions. The groove may have a finish that indicates the groove was formed by turning the cylinder on a machine tool. The first and second blocked portions may have a finish that indicates the first and second blocked portions were formed by pressing or stamping the groove. The first and second arcuate portions may have an angular extent of 140–175 degrees.

DETAILED DESCRIPTION OF THE PREFERRED EMBODIMENTS

Figure 1:
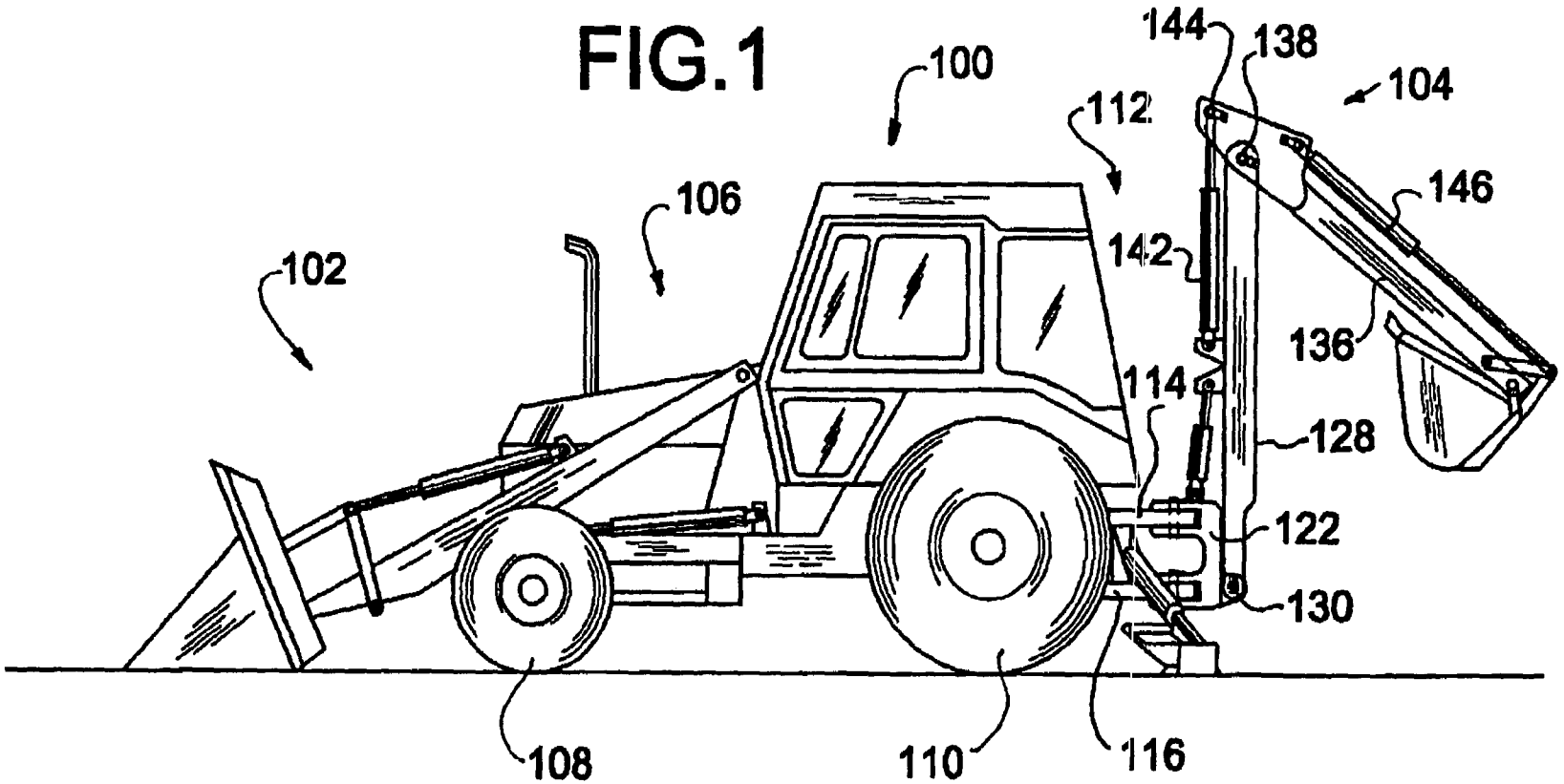
FIG. 1 is a left side view of a work vehicle, in particular a loader-backhoe in accordance with the present invention.
Figure 4:
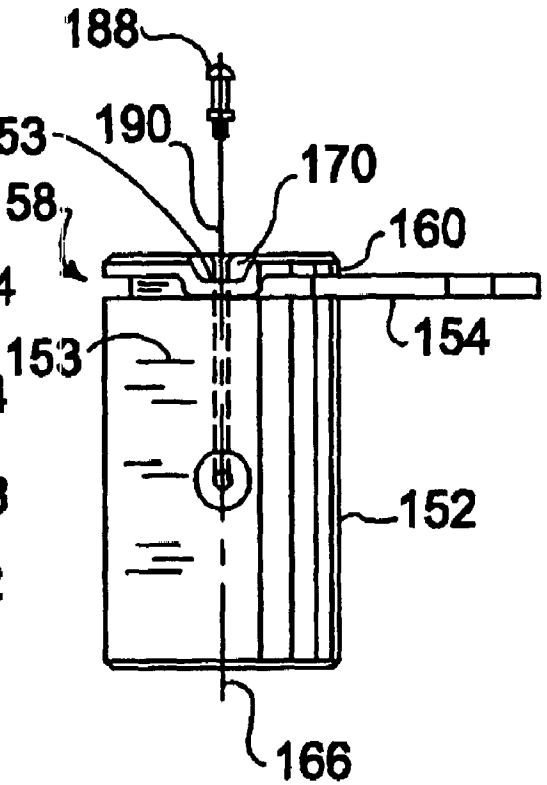
FIG. 4 is a left side view of the pin of FIGS. 1–3.
Figure 3:
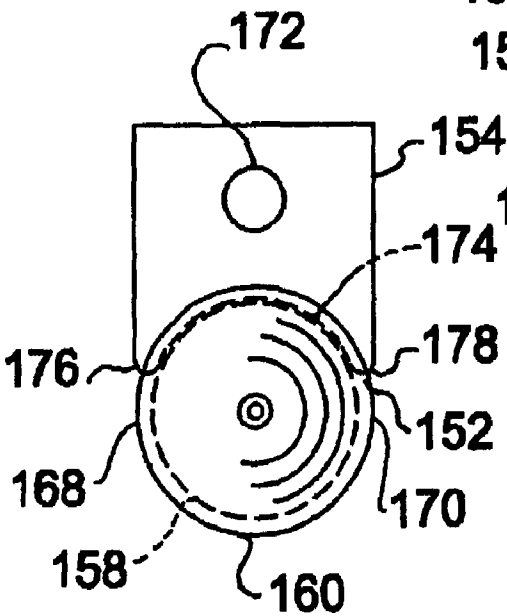
FIG. 3 is a top view of the pin of FIGS. 1–2 showing the pin and the pin retaining plate as they are inter-engaged when used.
Figure 2:
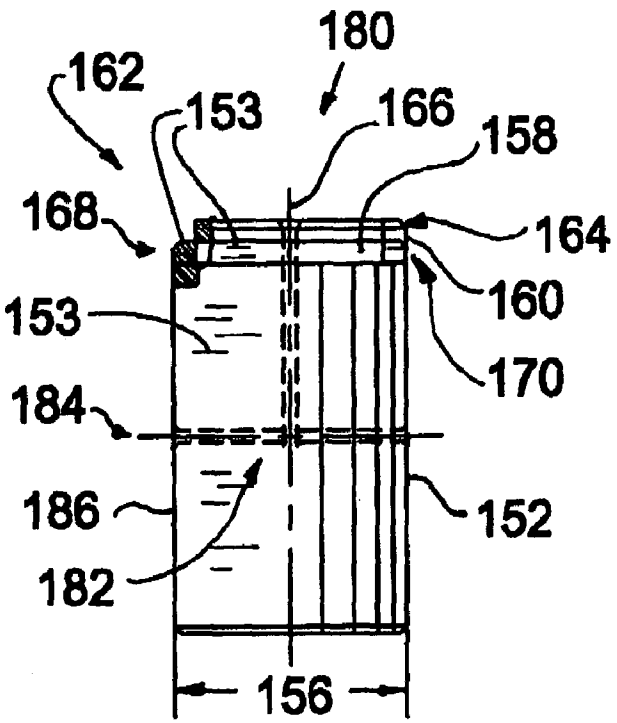
FIG. 2 is a front view of a pivot pin of the vehicle of FIG. 1 shown in partial cross section.

Referring to FIG. 1, a loader-backhoe 100 is shown having a loader attachment 102 and a backhoe attachment 104. The loader attachment 102 and backhoe attachment 104 are pivotally coupled to a tractor 106. Tractor 106 is supported on front wheels 108 and rear wheels 110 for movement over the ground. The rear 112 of loader-backhoe 100 has two elongate extending members including upper member 114 and lower member 166 that extend from rear 112. These members are disposed one above the other. Two through passages 118 and 120 (FIG. 5) extend through members 114 and 116, respectively.

Figures 5, 6:
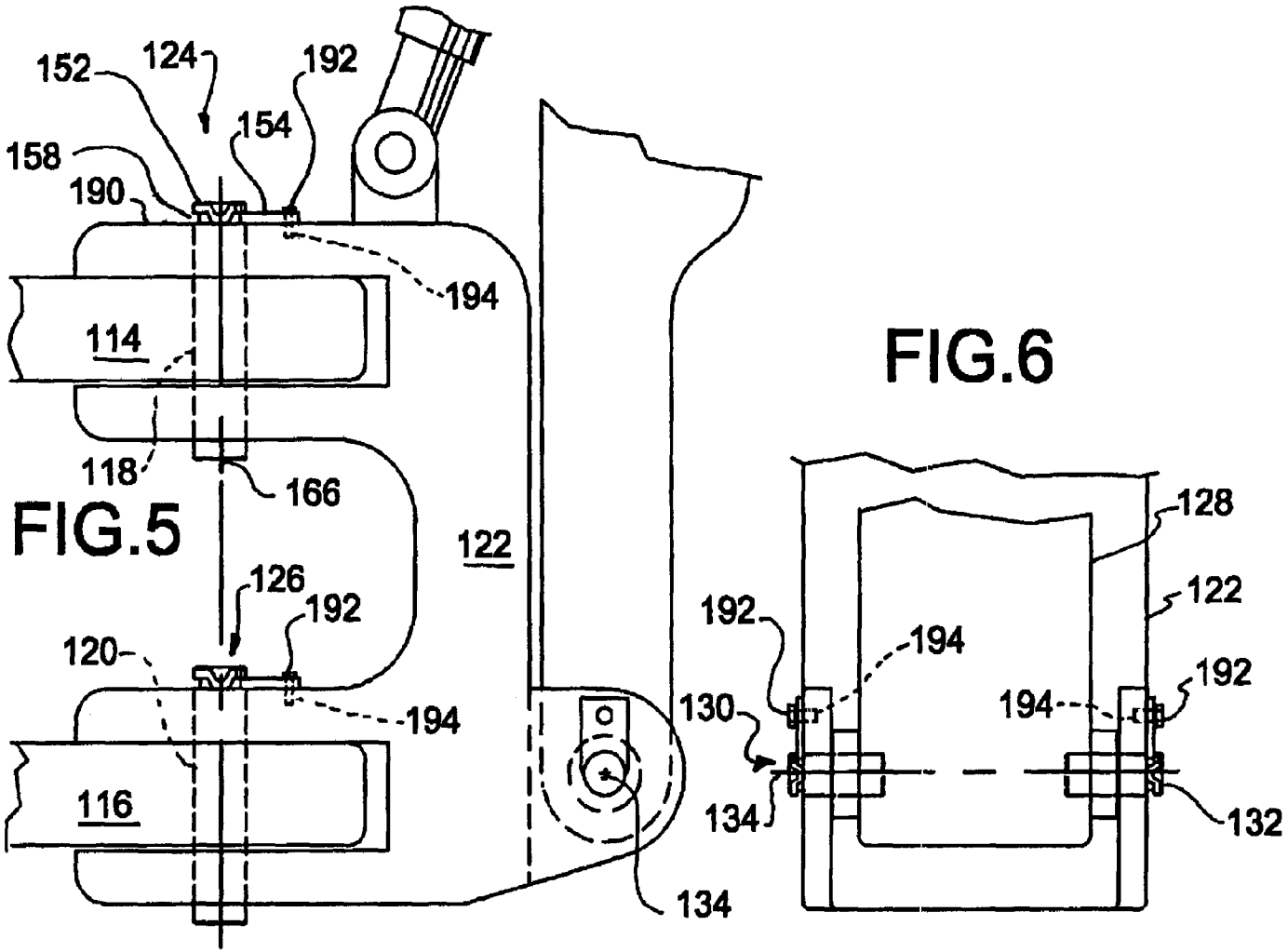
FIG. 5 is a fragmentary detail left side view of the rear portion of the tractor, the boom swing tower, and the boom of FIG. 1.
FIG. 6 is a fragmentary detail rear view of the vehicle of FIG. 1 showing the boom swing tower and the boom.
Figures 7, 8, 9:
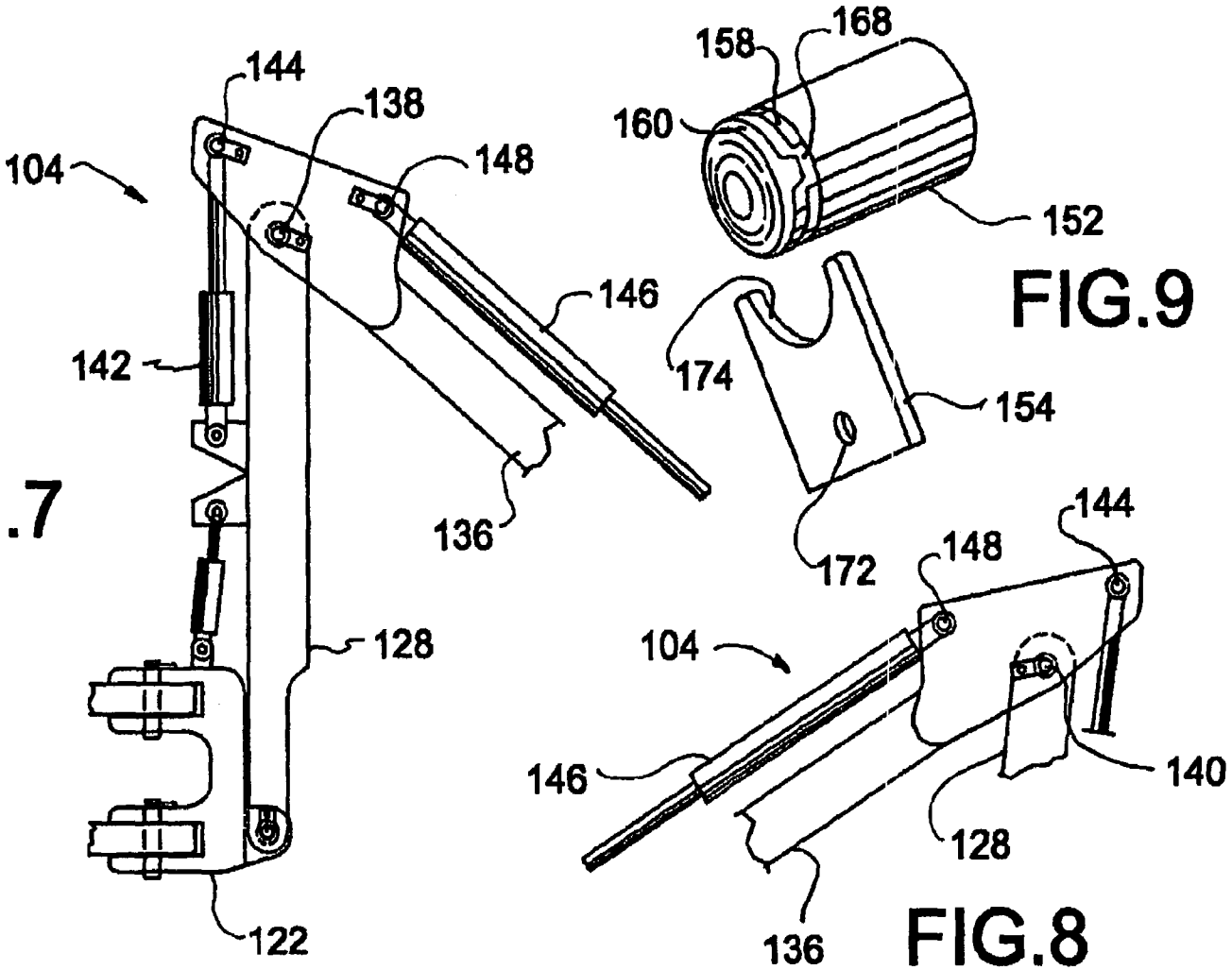
FIG. 7 is a fragmentary detail left side view of the rear portion of the vehicle of FIG. 1 showing the boom swing tower, boom, and upper portion of the dipper.
FIG. 8 is a fragmentary right side view of the upper portion of the boom and dipper of FIG. 1 showing the pivot joints.
FIG. 9 is a perspective view of a pin and its pin retaining plate showing their mode of assembly.

Backhoe attachment 104 is coupled to members 114 and 116 to pivot about a substantially vertical axis with respect to tractor 106. In particular, swing tower 122 is coupled to members 114 and 116 by pivot pin assemblies 124 and 126 (FIG. 5).

Backhoe 104 also includes a boom 128 that is pivotally coupled to swing tower 122 by pivot pin assemblies 130 and 132. Pivot pin assemblies 130 and 132 define a substantially horizontal pivotal axis between boom 128 and swing tower 122. Pivot pin assemblies 130 and 132 extend through swing tower 122 and boom 128 to define horizontal pivotal axis 134 about which boom 128 pivots with respect to swing tower 122.

Backhoe attachment 104 also includes dipper 136 that is pivotally coupled to the upper end of boom 128. Dipper 136 is coupled to boom 128 by two pivot pin assemblies 138 and 140. Pivot pin assemblies 138 and 140 define a substantially horizontal pivotal axis about which dipper 136 pivots with respect to boom 128.

Backhoe attachment 104 also includes a dipper cylinder 142 that is coupled to and between boom 128 and dipper 136 to pivot dipper 136 with respect to boom 128 when cylinder 142 extends and retracts. The upper end of hydraulic dipper cylinder 142 is pivotally coupled to dipper 136 by pivot pin assembly 144. Pivot pin assembly 144 extends through openings in both dipper 136 and the upper end of cylinder 142.

Backhoe attachment 104 also includes a hydraulic bucket cylinder 146 that is pivotally coupled to dipper 136 by pivot pin assembly 148. Pivot pin assembly 148 defines a substantially horizontal pivotal axis between dipper 136 and bucket cylinder 146.

FIGS. 2, 3, 4, and 9 illustrate details of the construction of all of pivot pin assemblies 124, 126, 130, 132, 138, 140, 144, and 148 which are identically constructed Each pin assembly 124, 126, 130, 132, 138, 140, 144, and 148 shown in detail in FIGS. 2, 3, 4, and 9 includes a pin 152 and a pin retaining plate (or pin retainer) 154. Pin 152 is cylindrical in form having a major diameter 156 that extends substantially the entire length of the pin. A circumferential groove 158 is disposed at one end of pin 152. Groove 158 is configured to receive retainer 154. Groove 158 preferably extends around the entire circumference of pin 152, preferably having a width of between 0.1 and 0.3 inches. It has a depth measured from the major diameter of pin 152 of between 0.2 and 0.5 inches.

Groove 158 is disposed at one end of pin 152 and is spaced between 0.1 and 0.3 inches from the end of the pin. This spacing produces a flange 160 that extends around the entire circumference of pin 152.

The pin is manufactured by turning an elongate metal member such as a steel rod on a machine tool (for example a lathe or screw machine) reducing its diameter with a turning tool until it has the desired outer diameter of the pin. The rod is further turned on a lathe or screw machine to create the groove. A turning tool reduces the diameter of the pin thereby creating the groove.

These turning processes cold-work the surface of the pin and the groove walls, leaving striations, indentations or scores 153 on the surface of the pin and groove that typically extend circumferentially around the outer diameter of the pin, and on the walls and bottom of the groove. These marks 153 indicate that the pin was turned to create its outer diameter and also that the groove was formed by turning. They indicate the process by which the surface of the pin and the surface of the groove were formed.

Once the basic pin body and groove have been made, the pin is placed in a press and two opposing sections 162 and 164 of flange 160 are bent in a direction parallel to the longitudinal axis 166 of pin 152 such that the opposing sections 162, 164 of the flange 160 are recessed below the end surface of the pin, and block two opposing portions 168, 170 of groove 158. By recessing sections 162, 164 of flange 160 into blocked portions 168, 170 of groove 158, the circumferential groove 158 is subdivided into two semicircular arcuate groove portions that are sized to receive the retaining plate. The blocked portions 168, 170 of groove 158 are disposed 180 degrees apart. The semicircular arcuate groove portions each have a length of between 140 and 175 degrees. They are preferably of equal length.

This process of recessing the flange into the groove leaves characteristic striations, indentations and scores 153 on the surface of the two opposing sections 162, 164 of flange 160 indicating that they are formed by being pressed or stamped in a direction generally parallel to the longitudinal axis of the pin until the recessed portions of the flange are plastically deformed into the groove 158.

Retainer 154 is in the form of a planar sheet of metal, preferably steel, that has an aperture 172 passing therethrough and one edge 174 that is configured to be inserted into either one of the semicircular arcuate portions of groove 158 that are formed when portions 168, 170 of groove 158 are blocked. Retainer 154 has a thickness along edge 174 that is slightly smaller than the width of groove 158. In this manner, retainer 154 can be easily inserted into groove 158 with no special tools. Retainer 154 is inserted into groove 158 in a direction generally perpendicular to longitudinal axis 166 of pin 152. It preferably is inserted to the bottom of groove 158 such that it engages the groove to a depth of 0.3 to 0.5 inches along an arc of 90 to 140 degrees.

The ends 176, 178 of edge 174 are preferably just adjacent to the crushed portions 168, 170 of groove 158. With retainer 154 in this position, pin 152 can rotate only a few degrees, preferably at least 5 degrees, but preferably no more than 90 degrees, more preferably no more than 45 degrees, even more preferably no more than 25 degrees, and most preferably no more than 10 degrees with respect to retainer 154. Groove 158 and retainer 154 are sized to provide a slight spacing between retainer 154 and pin 152 both in a direction parallel to longitudinal axis 166 and a direction perpendicular to axis 166. This spacing permits pin 152 to "float" slightly with respect to retainer 154, yet preventing pin 152 from leaving the members in which it is inserted. This allows for slight mechanical misalignments, roughness or irregularities in surfaces or other manufacturing tolerances that might otherwise prevent the use of a pin.

Pin 152 includes lubricating passageways formed integral with the pin that permit an operator of the vehicle to lubricate the pivot joints. These lubricating passageways include a first grease passage 180 that extends longitudinally through the center of pin 152 from the end of the pin at which groove 158 is located to a point 182 that is generally located midway between the two ends of pin 152.

A second passageway 184 extends from one side of cylindrical sidewall 186 of pin 152 to the other side of cylindrical sidewall 186 of pin 152. Passageway 184 intersects longitudinal axis 166 of pin 152 and passage 180. In this manner, a lubricant such as grease can be injected into the end of passage 180, can be forced down the length of passage 180 and can be forced outward through passage 184 until it exits pin 152 coating opposing sides of sidewall 186. The opposing ends of passageway 184 are configured to be located within the joint itself, preferably abutting the second member of the pivot joint (i.e. the member to which retaining plate 154 is not attached). Pin 152 is forced by retainer 154 to rotate with respect to the second member, and therefore the movement of the second member with respect to passageway 184 serves to distribute the lubricant that exits passageway 184. Any grease exiting the opposing ends of passageway 184 is thereby forced between the pin and the apertures of the vehicles in which its received to lubricate the pin. This reduces wear and extends the life of the pin 152 and the components in which it is inserted. A grease fitting 188 is preferably inserted into the open end 190 of passage 180 to ensure that no water enters the lubricating passages and that no grease can escape except through the ends of passageway 184.

The insertion of the pivot pin assemblies illustrated in FIGS. 2, 3, 4, and 9 into any of the locations indicated in the figures is relatively simple. First, the two pivoting members that are to be pivotally joined or coupled together are positioned with respect to each other such that mating holes on each component are coaxial. Once in this position, the operator inserts pin 152 into the aligned apertures until groove 158 is only slightly above the surface of the assembly.

At this point, the operator inserts edge 174 of retainer 154 into one of the semicircular groove portions formed by crushing opposing portions of circular groove 158. With retainer 154 in this position, the operator then slides a pin further into the aligned apertures of the structures that it is pinning together until retainer 154 abuts the surface of one of the structures. Using pivot pin assembly 124 (FIG. 5) as an example, the operator positions retainer 154 to abut surface 190 of swing tower 122. The operator aligns aperture 172 with threaded hole 194, inserts threaded fastener 192 through aperture 172 of retainer 154 and into threaded hole 194 of swing tower 122.

The operator rotates fastener 192 until the head of fastener 192 compresses retainer 154 against surface 190 and fixes retainer 154 in position against the top surface of the swing tower 122. Aperture 172 and threaded hole 194 are located such that when fastener 192 is threadedly engaged with hole 194 retainer 154 extends into groove 158 of pin 152 such that pin 152 can neither be inserted deeper into the holes in which it is received nor withdrawn from those holes.

The various holes and apertures are positioned such that pin 152 is not fixed rigidly with respect to swing towel 122 or to elongate member 114, when fastener 192 fixes retainer 154 against surface 190. Instead, the components are configured to provide pin 152 a slight amount of axial play (typically on the order of 0.050–0.100 inches) and also to provide pin 152 a small degree of rotational play about its longitudinal axis 166 (e.g. the 90, 45, 25, or most preferably 10 degrees of pin-to-retainer play mentioned above).

By permitting a slight degree of play with respect to retainer 154 and with respect to the structure retainer 154 is fastened to, pin 152 of pin assembly 124 can float lightly with respect to both structures and preferably seize against neither one of them. This floatation combined with the internal lubricating passageways 180, 184, substantially reduces the wear of the pin and the joint that it defines.

From the foregoing, it will be observed that numerous modifications and variations can be effected without departing from the true spirit and scope of the novel concept of the present invention. For example, the pins may be made of any of a variety of metals, such as steel, iron, aluminum, titanium, copper, brass, bronze, and nickel, or alloys or mixtures containing one or more of these metals, or other elements.

As another example, the particular arrangement and lengths of the couplings and elongated arms and members shown herein can be changed into their configurations. As another example more or fewer elongated members may be added to the backhoe or excavator linkage to make it longer or shorter without departing from this invention.

As another example, one or more members may be removed from the illustrated work vehicle members and still fall within the scope of the claims. The individual members may be reconfigured, such as by changing their length, their orientation, their construction, the size of the holes coupling the members, and the length of the holes that defined the pivot joints, while still falling within the scope of the appended claims.

It will be appreciated that the present disclosure is intended as an exemplification of the invention, and is not intended to limit the invention to the specific embodiment illustrated. The disclosure is intended to cover by the appended claims all such modifications as fall within the scope of the claims.

The invention claimed is:

1. A backhoe pivot joint comprising:

a first backhoe member having a first cylindrical opening:

a second backhoe member having a second cylindrical opening, wherein said first and second cylindrical openings are disposed in a coaxial relation;

a cylinder disposed in said first and second openings, said cylinder having a first end and a second end, said first end having a non-continuous circumferential groove having at least one blocked groove portion; and a retaining plate removably fixed to said first member and having a first edge disposed in said circumferential groove w engage said groove portion and prevent free rotation of the cylinder with respect to the retaining plate.

2. The backhoe joint of claim 1, wherein the at least one blocked groove portion includes at least first and second blocked portions.

3. The backhoe joint of claim 2, wherein the first and second blocked groove portions are disposed about 180 degrees apart.

4. The backhoe joint of claim 3, wherein the first and second blocked groove portions subdivide the circumferential groove into a first arcuate portion and a second arcuate portion, each of said first and second arcuate portions having substantially equal length.

5. The backhoe joint of claim 4, wherein the groove defines a flange, and further wherein portions of the flange recessed into the first and second blocked portions of the groove have a finish indicating that the first and second blocked portions were formed by pressing or stamping the flange.

6. The backhoe joint of claim 4, wherein the first end has first and second recesses adjacent to the first and second blocked portion.

7. The backhoe joint of claim 6, wherein the groove has a finish that indicates the groove was formed by turning the cylinder on a machine tool.

8. The backhoe joint of claim 7, wherein the groove defines a flange, and further wherein portions of the flange recessed into the first and second blocked portions at the groove have a finish indicating that the first and second blocked portions were formed by pressing or stamping the flange.

9. A backhoe pivot joint comprising:

a first backhoe member having a first cylindrical opening;

a second backhoe member having a second cylindrical opening, wherein said first and second cylindrical openings are disposed in a coaxial relation;

a cylinder disposed in said first and second openings, said cylinder having a first end and a second end, said first end having a circumferential groove having at least first and second blocked groove portion disposed about 180 degrees apart subdividing the circumferential groove into a first arcuate portion and a second arcuate portion, each of said first and second arcuate portions having substantially equal length; and a retaining plate removably fixed to said first member and having a first edge disposed in said circumferential groove to engage said groove portion a prevent free rotation of the cylinder with respect to the retaining plate;

wherein the first end has first and second recesses adjacent to the first and second blocked portions.

10. The backhoe joint of claim 9, wherein die groove has a finish that indicates the groove was formed by turning the cylinder on a machine tool.

* * * * *